US008570184B2

(12) United States Patent
Sundholm

(10) Patent No.: US 8,570,184 B2
(45) Date of Patent: Oct. 29, 2013

(54) METHOD AND SYSTEM FOR CONTROLLING, GUIDING AND WARNING

(75) Inventor: Göran Sundholm, Tuusula (FI)

(73) Assignee: Marimils Oy, Vantaa (FI)

( * ) Notice: Subject to any disclaimer, the term of this patent is extended or adjusted under 35 U.S.C. 154(b) by 212 days.

(21) Appl. No.: 13/063,022

(22) PCT Filed: Sep. 2, 2009

(86) PCT No.: PCT/FI2009/050694
§ 371 (c)(1),
(2), (4) Date: Mar. 9, 2011

(87) PCT Pub. No.: WO2010/029211
PCT Pub. Date: Mar. 18, 2010

(65) Prior Publication Data

US 2011/0163869 A1 Jul. 7, 2011

(30) Foreign Application Priority Data

Sep. 10, 2008 (FI) ..... 20085854

(51) Int. Cl.
*G08B 25/08* (2006.01)
*H04R 27/00* (2006.01)

(52) U.S. Cl.
USPC ..... 340/692; 340/286.11; 340/501; 340/506; 340/384.1; 381/82

(58) Field of Classification Search
USPC ..... 340/692, 286.11, 331, 332, 384.71, 340/628–630, 539.22, 691.1, 691.8, 501, 340/506, 384.1; 381/82, 71.1, 71.7, 77
See application file for complete search history.

(56) References Cited

U.S. PATENT DOCUMENTS

| | | | | |
|---|---|---|---|---|
| 4,796,018 | A * | 1/1989 | Nakanishi et al. | 340/691.1 |
| 6,873,256 | B2 * | 3/2005 | Lemelson et al. | 340/539.1 |
| 7,733,222 | B2 * | 6/2010 | Karim et al. | 340/539.22 |
| 2006/0214809 | A1 | 9/2006 | Sistare | |
| 2007/0041590 | A1 | 2/2007 | Tice | |
| 2007/0279242 | A1 | 12/2007 | Plocher et al. | |

FOREIGN PATENT DOCUMENTS

| | | | |
|---|---|---|---|
| GB | 2225661 | A | 6/1990 |
| JP | 5-135286 | A | 6/1993 |
| JP | 7-262461 | A | 10/1995 |
| JP | 10-320654 | A | 12/1998 |
| JP | 2000-194977 | A | 7/2000 |
| JP | 2000-285378 | A | 10/2000 |

(Continued)

OTHER PUBLICATIONS

Van Wijngaarden, et al., "Auditory Evacuation Beacons", J. Audio Eng. Soc., vol. 53, No. 1/2, Jan./Feb. 2005, pp. 44-53.

*Primary Examiner* — Anh V La
(74) *Attorney, Agent, or Firm* — Birch, Stewart, Kolasch & Birch, LLP

(57) ABSTRACT

A method for guiding, controlling or warning people, particularly for controlling and guiding people to a desired route, e.g. an emergency exit, in a dangerous situation, in which method, a person is guided by means of audio sources. In the method, audio sources (1*a*, 1*b*, 1*c*, 1*d*, 1*e*, 1*f*, 1*g*, 1*h*) arranged successively at a distance from each other are activated to produce sound, in which the audio sources successively arranged in the space guide the direction of an exit route by producing an audio signal with the audio source against the travel direction of the guided route (6).

21 Claims, 7 Drawing Sheets

(56) References Cited

FOREIGN PATENT DOCUMENTS

| | | | |
|---|---|---|---|
| JP | 2002-342849 | A | 11/2002 |
| JP | 2005-217777 | A | 8/2005 |
| JP | 2005-236737 | A | 9/2005 |
| JP | 2006-340159 | A | 12/2006 |
| WO | WO 2006/129539 | A1 | 12/2006 |

* cited by examiner

Fig. 1a
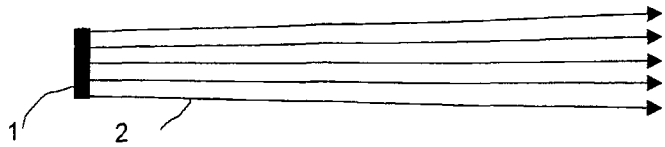
Fig. 1b
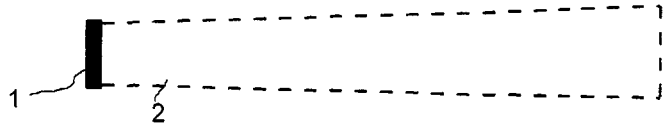
Fig. 2
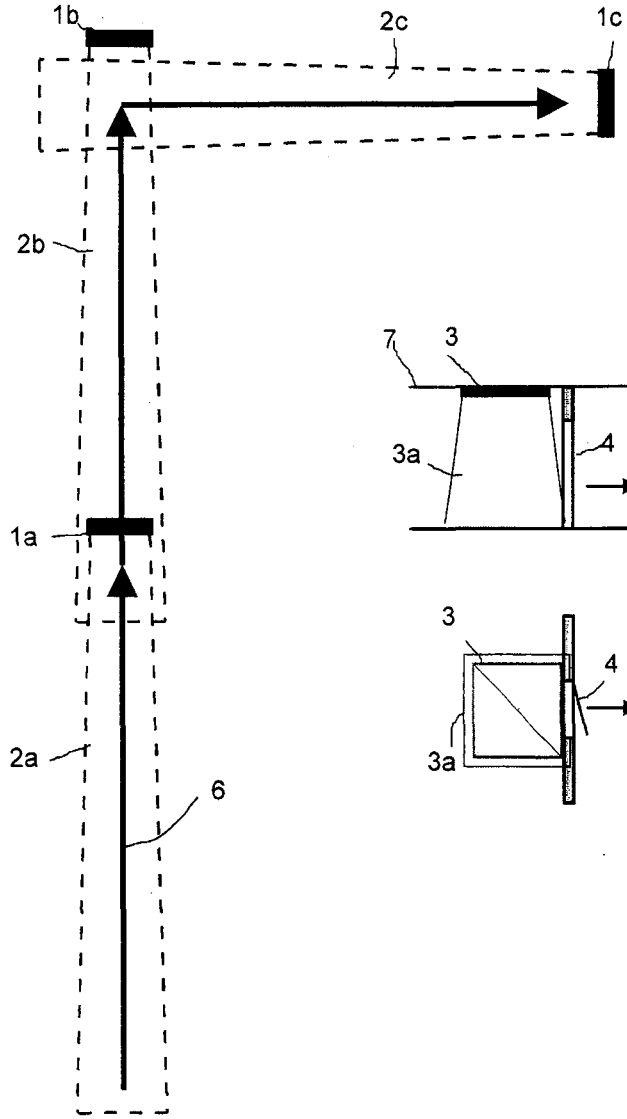
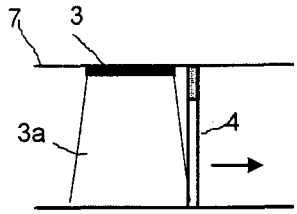
Fig. 3a
Fig. 3b

METHOD AND SYSTEM FOR CONTROLLING, GUIDING AND WARNING

BACKGROUND OF INVENTION

The invention relates to a method according to the preamble of claim 1.

The invention also relates to a system according to claim 12.

The invention generally relates to control, guidance and warning systems for people which guide, control and warn people with audio sources, particularly with successively arranged audio sources.

Various systems are known for guiding people in dangerous situations, such as in cases of fire, to the emergency exits of different buildings or ships. These are various visual means to indicate desired routes, such as emergency exit lights or emergency exits indicated otherwise, e.g. by reflector paint or tape.

For instance, guide lights are known in which light sources have been fastened successively in the shape of a strip. The light sources of the strip are arranged to turn on in a hazardous situation and to illuminate the exit. Many targets, such as hotels or passenger ships, have defined exits in emergency situations which people should follow when being evacuated. Often in emergencies, people do not act as designed and follow the predefined exit routes. This could have a number of reasons. It is possible that people do not notice possible emergency exit routes and signs guiding to them. Furthermore, people mostly prefer using routes they know in emergencies. On the other hand, a predefined exit can in a case of fire be impossible to follow due to the location of the fire, whereby known solutions might control in the wrong direction or even towards the fire.

A further disadvantage of typical systems based on visual signals for controlling, guiding and warning people is the fact that they cannot control people the ability of whom to sense visual signals has been temporarily or permanently impaired or who have no ability at all to sense visual signals. Furthermore, the conditions could be such, e.g. due to smoke formation, that visual signals are difficult to perceive.

An object of this invention is to provide a totally novel solution for a guidance, control and warning system by means of which the disadvantages of known solutions are avoided. Another object is to provide a system by means of which people, the ability of whom to observe visual signals has been impaired or is lacking, can be controlled as effectively as possible to a desired route, e.g. an emergency exit.

BRIEF DESCRIPTION OF INVENTION

The method according to the invention is mainly characterised by that, in the method, audio sources arranged successively at a distance from each other are activated to produce sound, in which the audio sources successively arranged in the space guide the direction of an exit route by producing an audio signal with the audio source against the travel direction of the guided route.

Furthermore, the method according to the invention is characterised by what is stated in claims 2-10.

The system according to the invention is mainly characterised by that the system comprises audio sources arranged successively at a distance from each other which are, when activated, arranged to guide the direction of an exit route by producing an audio signal with the audio source against the travel direction of the guided route.

The system according to the invention is further characterised by what is stated in claims 13-21.

The arrangement according to the invention has numerous significant advantages. By means of the method and system according to the invention, it is possible to guide people effectively along desired exit routes in a dangerous situation when audio sources are activated and sounds guide people towards the exits. Then, people are prevented or at least efficiently guided from going in the wrong direction towards the fire. By using very directional audio sources, the audio pattern of which ranges quite far and does not disperse, it is possible to provide control and guidance with a relatively small number of audio sources. On the other hand, the direction of the audio source can be sensed extremely well, whereby inaccuracies in guidance are avoided. Audio sources can be arranged along the route at suitable points, such as on walls, hanging on the ceiling. The audio sources are arranged such that their audio pattern, i.e. sound direction and range, is directed along the route. The audio pattern produced by the audio sources of the system can be changed when required, whereby it is possible to effectively affect the direction of the guided route. The arrangement according to the invention can guide people the ability of whom to sense visual signals has been impaired, such as visually handicapped. Furthermore, the system intensifies the operation of visual control, guidance and warning systems by means of sound.

BRIEF DESCRIPTION OF FIGURES

Next, the invention will be described in more detail by means of an example with reference to the accompanying drawings in which FIG. 1*a* schematically shows an audio source of the system as simplified, FIG. 1*b* schematically shows an audio source of the system as simplified, FIG. 2 shows an arrangement according to the invention as simplified, FIG. 3*a* shows a side view of a detail in an embodiment of an audio source of the system, FIG. 3*b* shows a top view of the arrangement in FIG. 3*a*, FIG. 4 schematically shows a top view of a system according to an embodiment of the invention, FIG. 5 schematically shows the signals of two audio sources compared to each other on the time axis, FIG. 6 schematically shows a top view of another system according to an embodiment of the invention, FIG. 7 schematically shows a top view of an embodiment of a system according to the invention, FIG. 8 schematically shows a top view of a further embodiment of a system according to the invention.

DETAILED DESCRIPTION OF INVENTION

Figure 4:
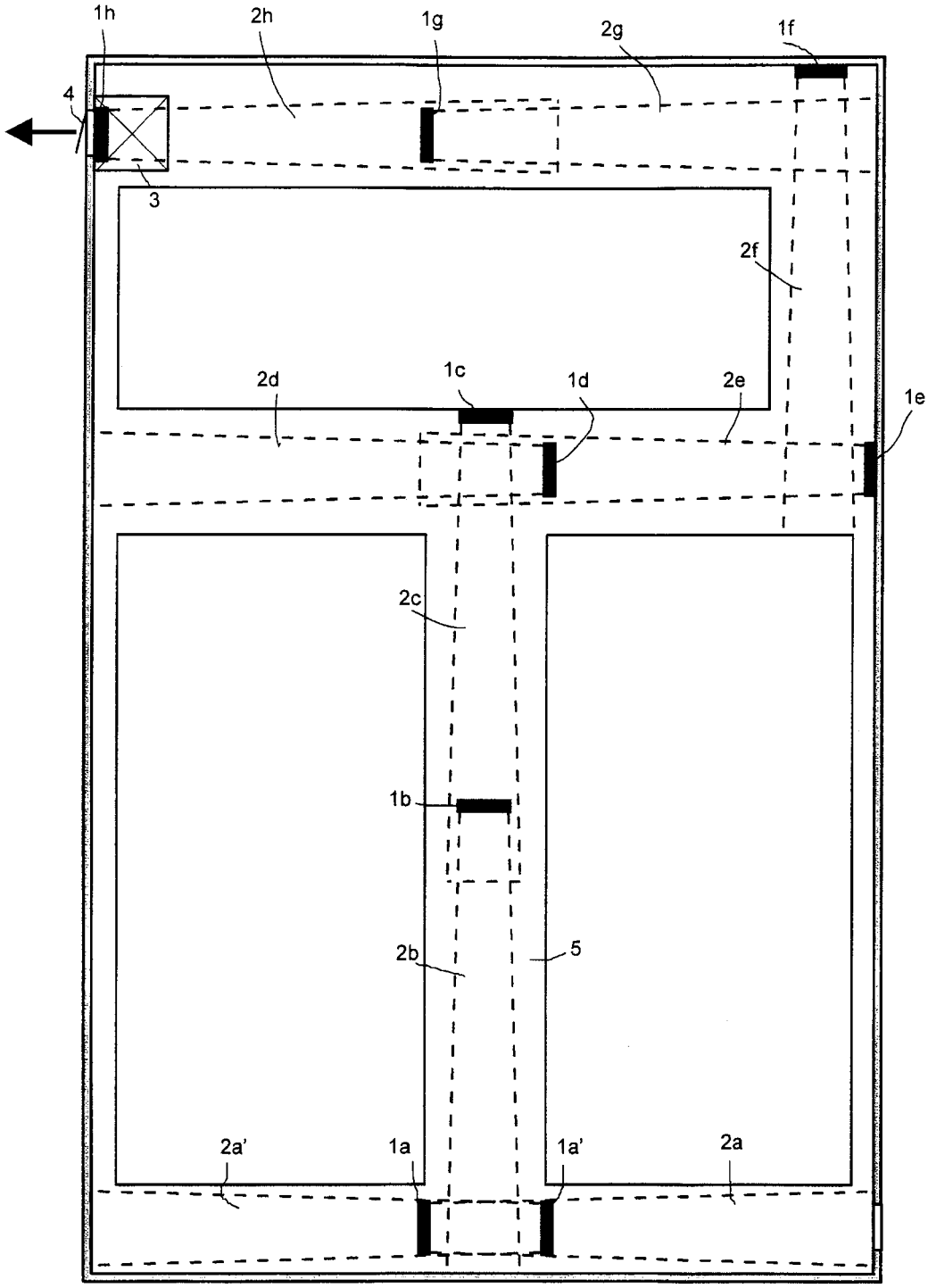

FIGS. 1*a* and 1*b* show as simplified an audio source 1 and an audio pattern 2 provided by the audio source which has a specific direction and range a person can hear or sense. FIG. 1*a* shows the propagation direction of sound in the audio pattern with arrows. In FIG. 1*b*, this has been simplified for clarity and the designation of FIG. 1*b* has been used in the figure of the description.

FIG. 2 shows a simplified illustration of the method and system according to the invention on how it is possible by arranging audio sources 1*a*, 1*b*, 1*c* successively at a distance from each other to guide a person to follow a desired route 6 by means of the sound produced by the audio sources.

According to FIG. 2, the person senses, particularly hears or feels, a sound 2*a* given by the first audio source 1*a* and moves towards the incoming direction of the sound i.e. the first audio source 1*a*. When moving towards the first audio source, the person starts to hear a sound 2*b* produced by the second audio source 1*b* ranging until the range of the sound 2*a* produced by the first audio source 1*a*. The person further continues to move towards the sound of the second audio source which intensifies the closer to the audio source the person comes. Near the second audio source 1*b*, the person hears a sound 2*c* produced by the third audio source 1*c* being on the right in the travel direction, whereby the person will know that the direction of the route 6 changes and will turn towards the third audio source 1*c*.

The invention is thus based on an idea in which people are controlled by means of sound using audio sources 1*a*, 1*b*, 1*c*, 1*d*, 1*e*, 1*f*, 1*g*, 1*h* arranged successively. The people are controlled to move towards the incoming direction of the sound. The invention particularly utilises audio sources producing very directional sound, whereby it is possible to extremely accurately control people along a specific route. It is substantial and advantageous of the invention that it is possible to use audio sources which produce accurately directional sound the incoming direction of which can be sensed. The audio sources can be positioned such that no harmful reflections are caused to sound waves which could confuse the direction when guiding people solely by means of sound.

According to an embodiment of the invention, FIGS. 3*a* and 3*b* show a simplified situation in which an audio source 3 has been positioned up and a sound 3*a* has been directed downwards from above somewhat vertically. This is used in the system according to the invention to indicate a point where the person should stop e.g. at the point of a door 4 or equivalent.

FIG. 4 schematically shows a space where there are corridors 5 and at least one door 4, such as the door of an exit. It can be considered being e.g. a ship cabin compartment or a section of a hotel floor where only the corridor spaces are shown for clarity. In this context, the corridor 5 generally refers to a passage along which people are to be controlled. In the space are arranged audio sources 1*a*, 1*b*, 1*c*, 1*d*, 1*e*, 1*f*, 1*g*, 1*h*, 3 which are intended to catch attention and installed along a desired guidance route, such as an exit. The route proceeds from a point which is farther from the end of guidance to a point which is closer to the end of guidance. In the figure, there are nine audio sources which are arranged such that, when arranged successively, their sounds 1*a*, 1*b*, 1*c*, 1*d*, 1*e*, 1*f*, 1*g*, 1*h*, 3 cover the desired route.

In the figures, dashed lines show the direction and range of the sound of each audio source. The audio sources are very directional audio sources the sound waves of which do not disperse widely but maintain their direction. In this case, a person who wishes to move towards the door 4 is controlled all the way based on the sounds produced by the audio sources 1*a* . . . 1*h*. The person moves towards the sound of the audio source until hearing the sound produced by the next audio source and continuing towards it. The person is at the destination when hearing the sound directly from above from the audio source 3.

Figure 5:
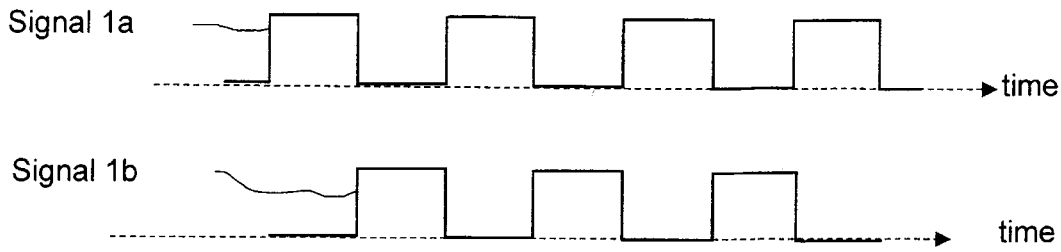

FIG. 5 shows a signal given by two different audio sources on the time axis. In the embodiment of the figure, the audio sources give an audio signal at specific time intervals. The audio signals given by the successive audio sources 1*a*, 1*b* are arranged in relation to each other such that the audio sources give the audio signal in turns. Then, confusing the sounds is avoided well and the control ability of the system is improved. It is also possible to employ other suitable means for separating signals produced by successive audio sources from each other.

The method and system according to the invention can also use as the audio sources 1*a* . . . 1*h*, 3 advantageously audio elements directing sound waves extremely well, e.g. planar audio elements. The planar audio elements are typically speaker panels extremely light and thin, of the thickness of some millimeters. They can be inconspicuously installed in e.g. public spaces. If desired, they can be covered, cut, bent, framed or combined into larger surfaces. An important feature from the viewpoint of the invention is the controllability of sound typical for a planar audio element, whereby the sound can be directed exactly in a specific direction. The sound produced by the planar audio element also ranges quite far without weakening its quality and volume. According to an advantageous embodiment, it is possible to use elements the dispersion of the sound directionality of which is extremely low, e.g. in the range of 0-4 degrees in a specific frequency range. A means suitable for the audio source is e.g. Panphonics Oy's planar audio element Audio Element SoundShower®.

In an emergency, the arrangement according to the invention can be used for controlling, guiding people to exit routes, e.g. an emergency exit route. The emergency can be e.g. a case of fire. The audio sources can be controlled with a control system, whereby the control system can receive signals from one or more fire detectors connected to it.

Figure 6:
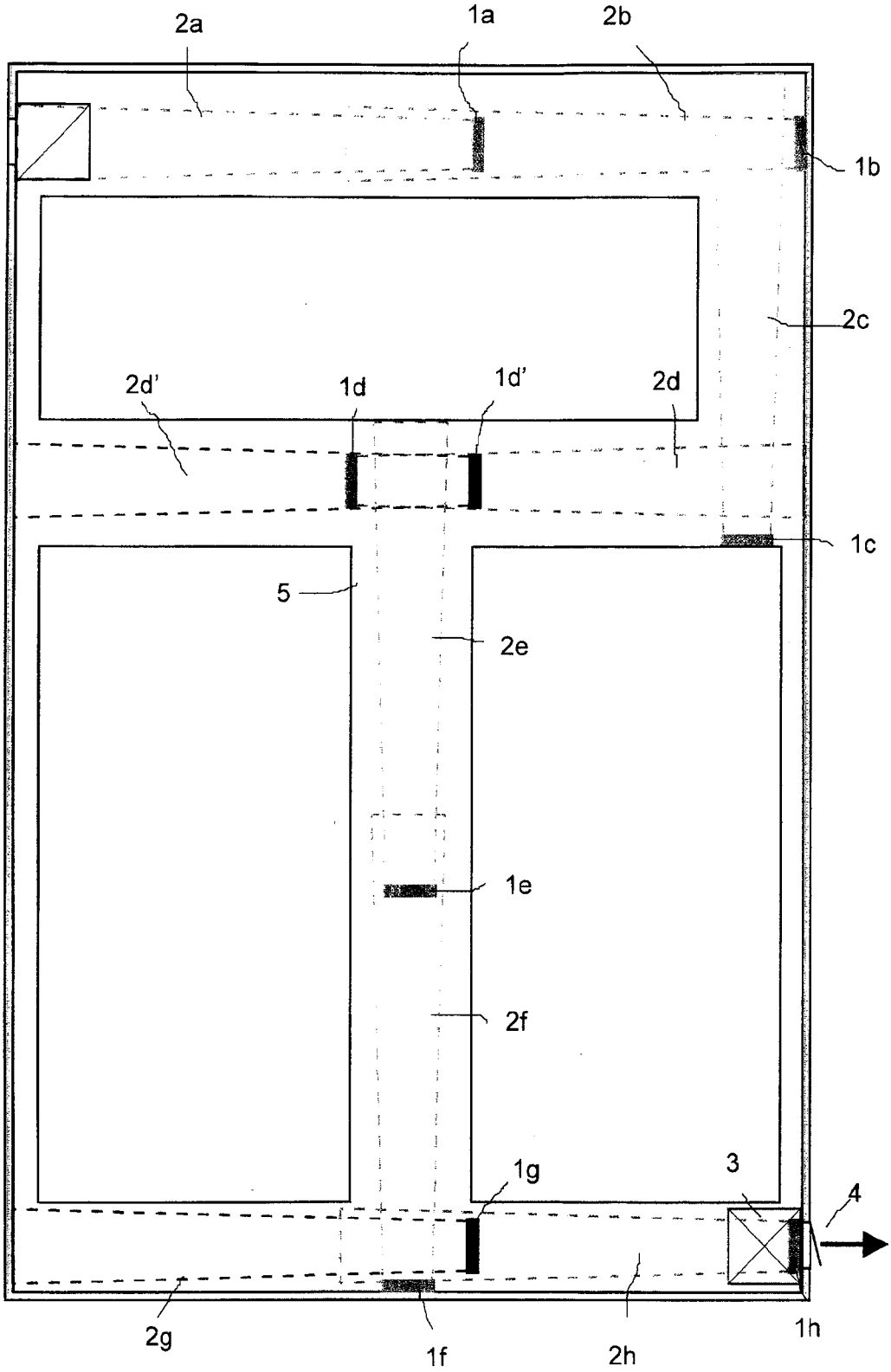

FIG. 6 shows an embodiment of a system of the invention in which the audio sources are arranged to control the way to the exit door 4.

Figure 7:
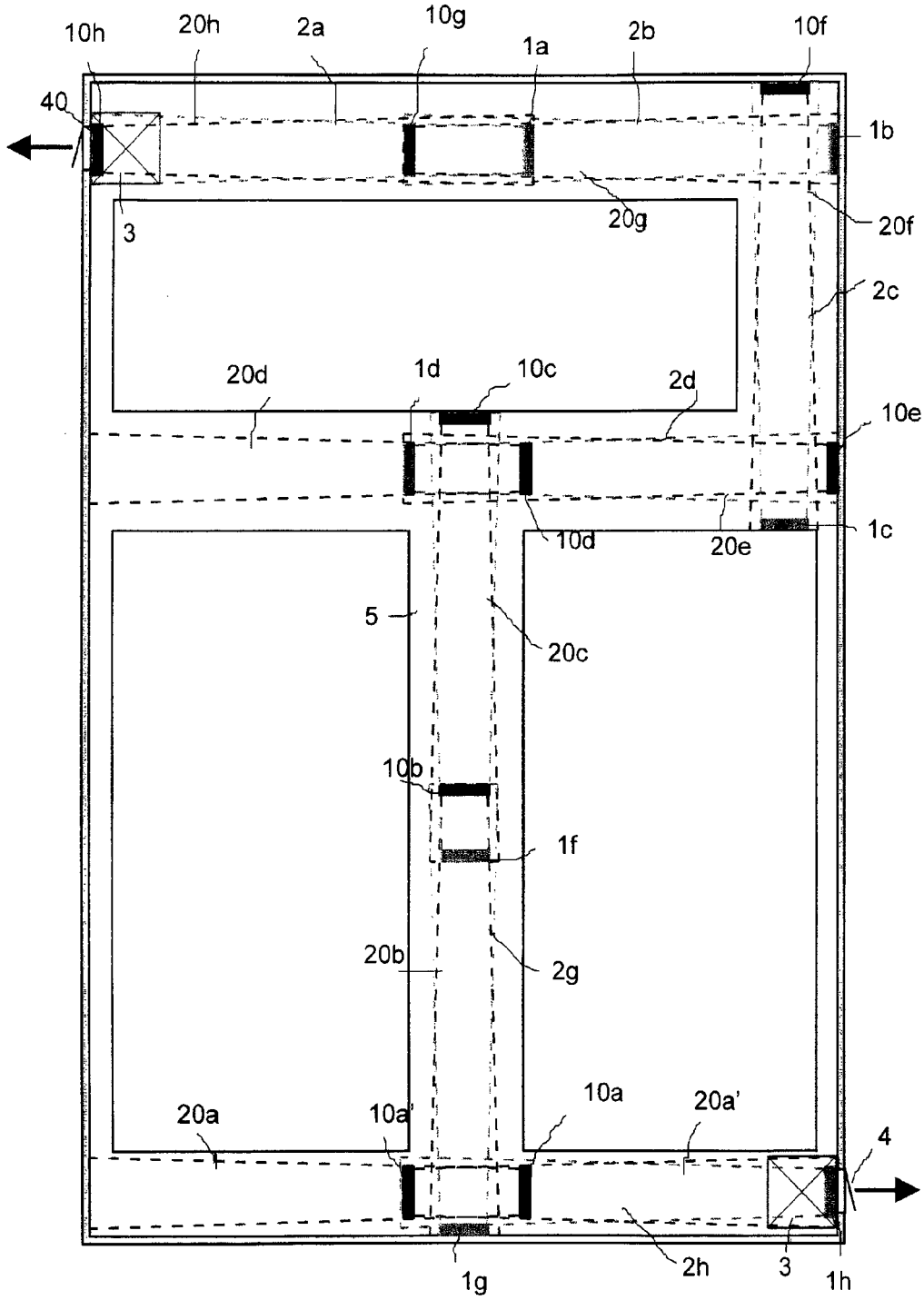

FIG. 7 shows an embodiment in which a set of audio sources is arranged in a space into connection with its passages. The audio sources are arranged to cover possible control and guidance requirements of the passages of the space. The space has two exits 4, 40. A first part of the audio sources 1*a* . . . 1*h* is mainly intended to guide to the first exit 4. A second part of the audio sources 10*a* . . . 10*h* is mainly intended to guide to the second exit 40. It is possible to use some of the audio sources to guide to routes going to one exit or both exits. Depending on the hazard, it is then possible to connect the suitable audio sources to control moving along a route passing away from the danger and not along a route passing towards the danger. In a dangerous situation, the audio sources of the same corridor space controlling in the opposite directions can be connected such that the audio source on the side of the danger does not turn on or that the sound level it produces is lower, whereby the people are not controlled towards the danger area. According to another embodiment, the sound level of the audio source on the side of the better exit is intensified, whereby the system controls people more effectively towards the safer exit.

Figure 8:
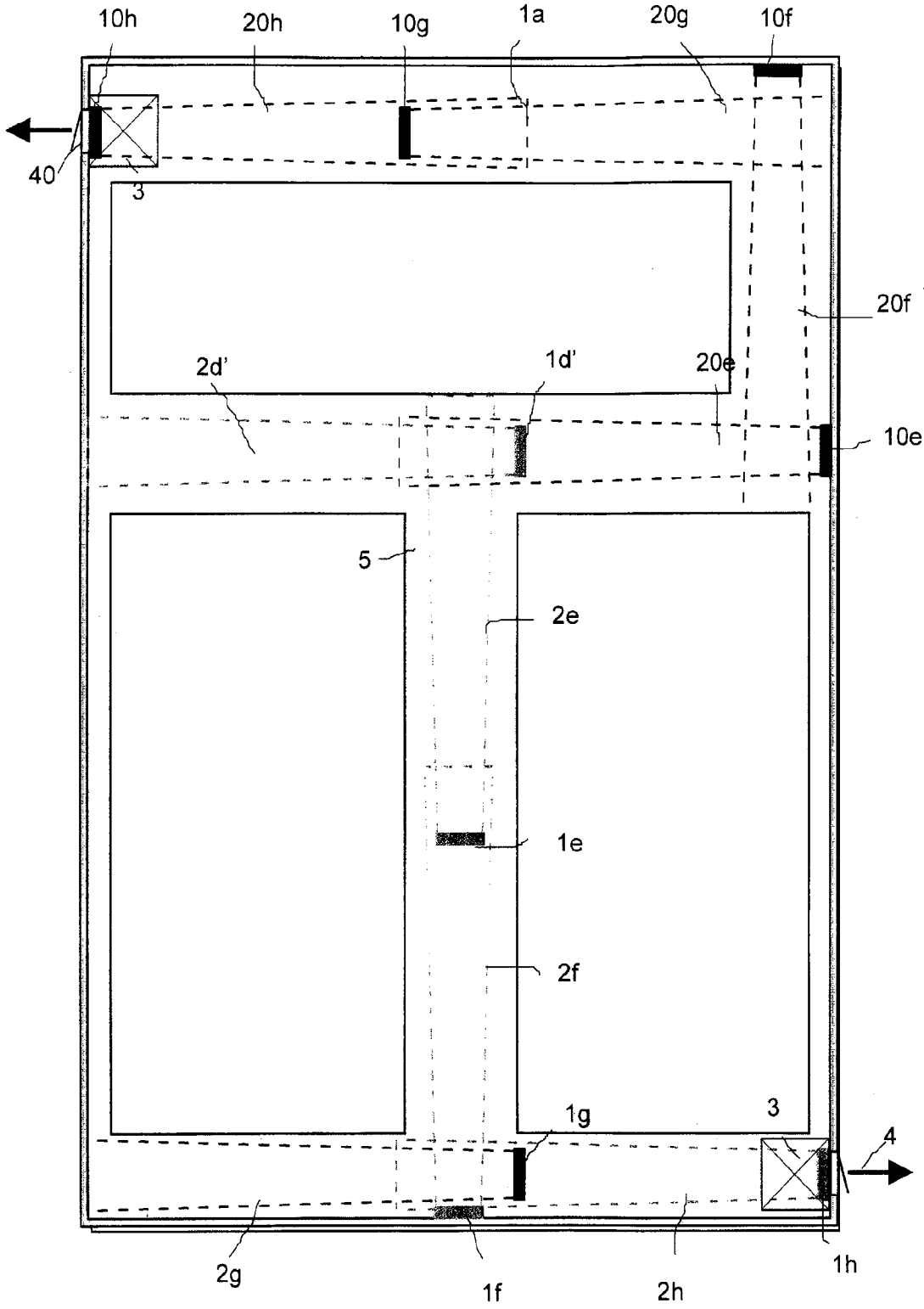

FIG. 8 shows a further embodiment in which the audio sources 1*d*', 1*e*, 1*f*, 1*g*, 1*h*; 10*e*, 10*f*, 10*g*, 10*h* guide mainly to a route which leads to the nearest exit 4, 40.

Figure 9A:
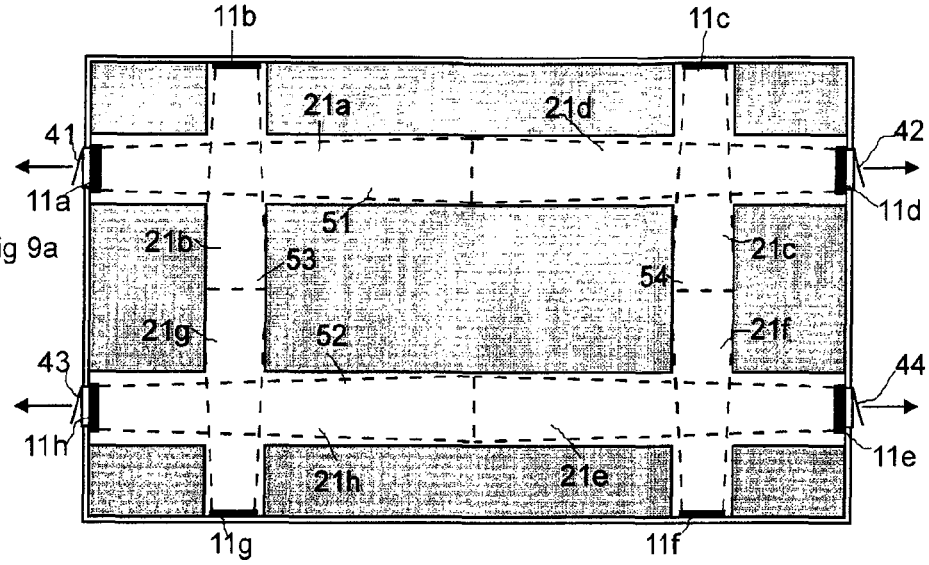
FIGS. 9*a*, 9*b* and 9*c* show the operation of a system according to the invention in various situations.
Figure 9B:
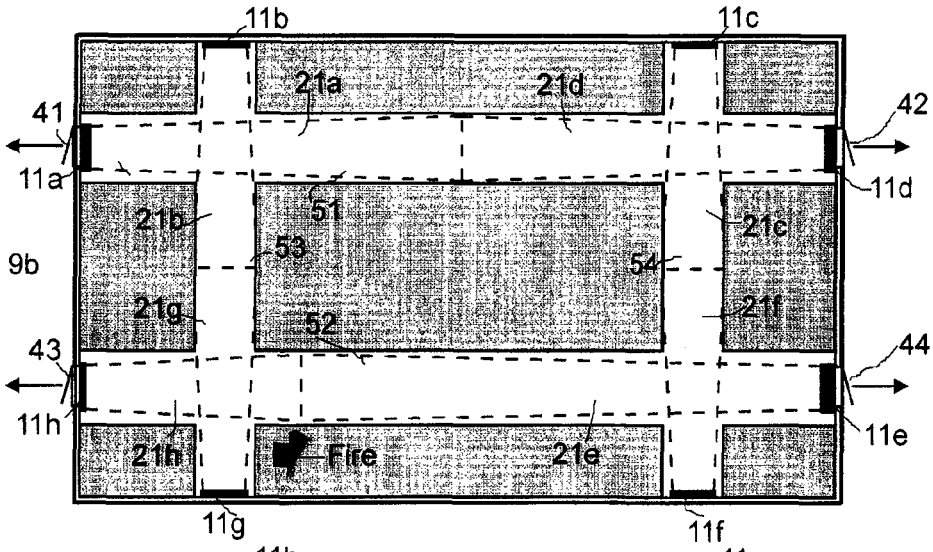
Figure 9C:
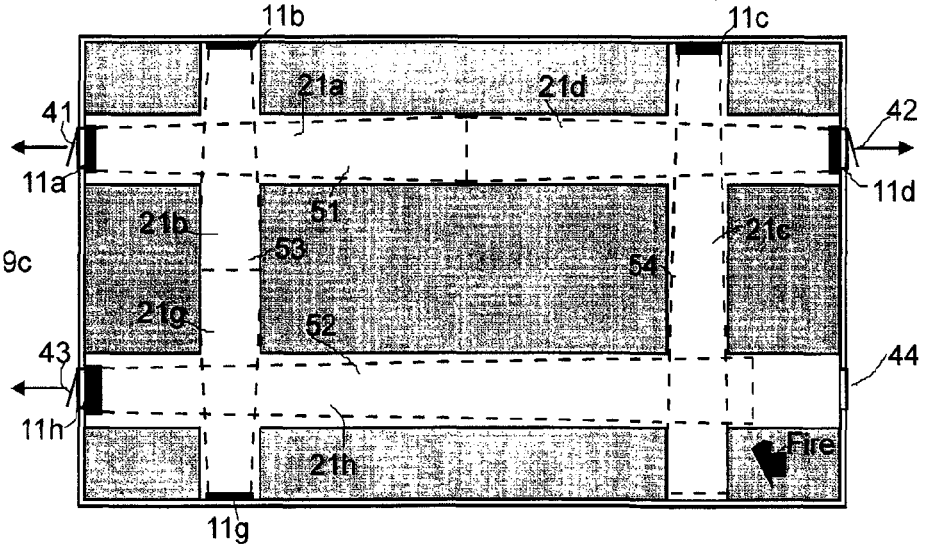

FIGS. 9*a*, 9*b*, 9*c* show a space, e.g. a cabin compartment, where there are cabins (not numbered) and corridor spaces 51, 52, 53, 54 between them. The compartment has four exits 41, 42, 43, 44. In the corridor spaces of the compartment is arranged a system according to the invention in which there are audio sources 11*a*, 11*b*, 11*c*, 11*d*, 11*e*, 11*f*, 11*g*, 11*h* which equivalently have directional audio patterns 21*a*, 21*b*, 21*c*, 21*d*, 21*e*, 21*f*, 21*g*, 21*h*. In the embodiment of the figures, each corridor space is arranged with two audio sources, one at each end of the corridor. For instance, in the corridor space 51 there is the first audio source 11*a* and at the opposite end the second audio source 11*d*. The audio sources are directed against each other such that the audio patterns 21*a*, 21*d* of the audio sources 11*a*, 11*d* range until the middle of the length of the corridor 51. In an equivalent way, there are the audio sources 11*h*, 11*e* in the corridor 52, the audio sources 11*b*, 11*g* in the corridor 53 and the audio sources 11*c*, 11*f* in the corridor 54. The corridor spaces 51 and 52 are parallel at a distance from each other and the corridor spaces 53 and 54 are parallel to each other and crosswise in relation to the corridor spaces 51 and 52. FIG. 9*a* shows a situation in which the system aims at controlling people from the corridors of the space evenly to all of the four exits 41, 42, 43, 44.

FIG. 9*b* shows a situation in which there is a fire in the space. The system receives a signal e.g. from an automatic fire detector which has located the point of the fire (Fire) or a manual alarm has been given. In the embodiment of the figure, the fire is along the corridor 52. The audio sources of the corridor are arranged to change the sound volume or audio pattern range such that people are not controlled towards the fire (Fire). Based on this, the audio pattern 21*h* produced by the audio source 11*h* is shorter in the corridor space and the second audio pattern 21*e* produced by the audio source 11*e* is longer. Then, the controlled route can be affected by altering the properties of the audio signal produced by the audio sources, such as sound pressure.

FIG. 9*c* shows another situation in which there is a fire (Fire) in a space near the exit 44. Then, the fire is close to the end of the corridor 52 on the side of the exit 44, whereby the audio sources in its vicinity do not produce sound, because the system does not now control out of the space via the exit 44. Instead, the audio pattern produced by the audio sources 11*h* and 11*c* of the corridor spaces 52 and 54 of the fire site at the opposite end in relation to the site ranges now in the vicinity of the fire site and tries to control away from it. The audio signal of the audio sources in question is e.g. intensified such that a more intense sound is also heard until the opposite end of the corridor.

The audio sources 1*a* . . . 1*h*, 3 can also have other operating modes than the ones described above. For instance, they can be utilised in marketing, communication or playing music.

Next, characteristics of some embodiments of the invention will be introduced: The invention relates to a method for guiding, controlling or warning people, particularly for controlling and guiding people to a desired route, e.g. an emergency exit, in a dangerous situation, in which method, a person is guided by means of audio sources. In the method, audio sources 1*a*, 1*b*, 1*c*, 1*d*, 1*e*, 1*f*, 1*g*, 1*h* arranged successively at a distance from each other are activated to produce sound, in which the audio sources successively arranged in the space guide the direction of the exit route by producing an audio signal with the audio source against the travel direction of the guided route 6.

In the method, the audio sources 1*a*, 1*b*, 1*c*, 1*d*, 1*e*, 1*f*, 1*g*, 1*h*, 3 produce a directional audio pattern 2*a*, 2*b*, 2*c*, 2*d*, 2*e*, 2*f*, 2*g*, 2*h*, 3*a*.

In the method, the audio pattern 2*b* of the audio source 1*b* farther behind in the travel direction of the route ranges until the audio pattern 2*a* of the preceding audio source 1*a*.

The audio signals of two successive audio sources are formed distinguishable from each other, e.g. by sequencing sound and/or altering the frequency of sound.

In the method, the sound 3*a* directed straight downwards from above from the audio source 3 positioned up means a point which requires special actions, such as e.g. stopping, a door 4 or a staircase.

The audio source is an audio element producing very directional sound, e.g. a planar audio element.

The audio source produces a directional audio pattern which ranges at a distance of 5-40 m from the audio source, advantageously 10-40 m, most advantageously 30-40 m.

At sites which have several exits, the successively arranged audio sources are arranged to guide to the nearest exit and/or arranged to distribute the people at the site dividedly to different exits.

At sites which have several exits 4, 41, 42, 43, 44, the audio sources are arranged to guide away from the dangerous situation, such as a fire site.

The audio sources are at other times utilised for communicating information, marketing or playing music.

The successive audio sources are arranged at a distance, which is in the range of 10-40 m, advantageously 20-30 meters, from each other.

A guidance, control or warning system, particularly for controlling and guiding people to a desired route, e.g. to an emergency exit route, in a dangerous situation, comprises audio sources. The system comprises audio sources 1*a*, 1*b*, 1*c*, 1*d*, 1*e*, 1*f*, 1*g*, 1*h* arranged successively at a distance from each other which are, when activated, arranged to guide the direction of an exit route 6 by producing an audio signal with the audio source against the travel direction of the guided route 6.

The audio source 1*a*, 1*b*, 1*c*, 1*d*, 1*e*, 1*f*, 1*g*, 1*h* is arranged to produce a directional audio pattern.

In the travel direction of the route, the audio pattern 2*b* of each audio source 1*b* farther behind is arranged to range until the audio pattern 2*a* of the preceding audio source 1*a*.

The audio signals of two successive audio sources are arranged distinguishable from each other, e.g. by sequencing sound and/or altering the frequency of sound.

The audio source is an audio element producing very directional sound, e.g. a planar audio element.

The audio source is arranged to produce a directional audio pattern which ranges at a distance of 5-40 m from the audio source, advantageously 10-40 m, most advantageously 30-40 m.

The successive audio sources are arranged at a distance, which is in the range of 10-40 m, advantageously 20-30 meters, from each other.

In the system, the audio sources are arranged to alter the directional audio pattern produced by the audio source, e.g. by changing sound pressure.

The system is arranged fittable to buildings, such as hotels, public spaces, shopping centres, passenger terminals, service stations, office buildings, residential buildings or equivalents, or to ships, such as passenger ships.

The audio sources are arranged to be utilised at other times for communicating information, marketing or playing music.

It is obvious to those skilled in the art that the invention is not limited to the embodiments described above, but it may be varied within the scope of the enclosed claims. When necessary, the features possibly described in this specification together with other features may also be used separately from each other.

The invention claimed is:

1. A method for guiding, controlling or warning people along a desired travel route leading to a specific point on the route, the method comprising:

arranging first audio sources successively at a distance from each other along one or more linear travel directions in the desired travel route leading to the specific point, and activating each of the first audio sources to produce a directional audio signal which is communicated directly against each of the one or more of the linear travel directions of the desired travel route leading to the specific point on the route, the method further comprising:

locating a second audio source adjacently to specific ones of the first audio sources located at each of the specific points on the desired travel route which requires a special action, the specific points of the route requiring the special action including an exit, a door, or a staircase, and causing each of the second audio sources at the specific points requiring the special action to produce a second sound signal which is directed straight downwardly from above, thereby distinguishing the second sound signal, which is directed downwardly from above, from the directional audio signal of the adjacent first audio source, which is communicated directly against each of the one or more of the linear travel directions.

2. The method according to claim 1, wherein the method further comprising:

producing the directional audio signal with a sound dispersion range of 4 degrees or less.

3. The method according to claim 1, the method further comprising:

extending an audio pattern of each of the first audio sources further behind in the desired travel direction of the route into an audio pattern of an immediately preceding first audio source.

4. The method according to claim 1, the method further comprising:

causing the directional audio signals of two successive ones of the first audio sources, which are communicated directly against each of the one or more the linear travel directions of the desired travel route, to be distinguishable from each other by altering a frequency of at least one of the audio signals.

5. The method according to claim 1, wherein each of the first audio sources is a planar audio element.

6. The method according to claim 1, the method further comprising:

producing a directional audio pattern from each the first audio sources that extend at a distance of 10-40 meters.

7. The method according to claim 1, wherein, at sites which have several exits, the method further comprising:

arranging the first audio sources to guide the people away from a dangerous situation including a fire site.

8. The method according to claim 1, wherein, the successive audio sources are arranged at a distance which is 20-30 meters from each other.

9. A guidance, control or warning system for controlling and guiding people along desired travel routes leading to each of several exits at a site, the system comprising:

first audio sources arranged successively at a distance from each other which, when activated, are arranged to guide people along one or more linear travel directions in the desired travel routes leading to the several exits, wherein each of the first audio sources producing a directional audio signal which is communicated directly against each of the one or more the linear travel directions of the desired travel routes, wherein the first audio sources are arranged successively in the desired travel routes to guide the people, to the exit nearest to each of the people.

10. The guidance, control or warning system according to claim 9, further comprising:

a second audio source located adjacently to the first audio source located at each of the specific points on the desired travel route which requires a special action, the specific points of the route requiring the special action including an exit, a door, or a staircase, and wherein each of the second audio sources at the specific points requiring the special action produces a second sound signal which is directed straight downwardly from above, thereby distinguishing the second sound signal, which is directed downwardly from above, from the directional audio signal of the adjacent first audio source, which is communicated directly against each of the one or more of the linear travel directions.

11. The guidance, control or warning system according to claim 9, wherein, the directional audio signals of two successive ones of the first audio sources, which are communicated directly against each of the one or more the linear travel directions of the desired travel route, are made to be distinguishable from each other by altering a frequency of at least one of the audio signals.

12. A guidance, control or warning system for controlling and guiding people along a desired travel route leading to a specific point on the route, the system comprising:

first audio sources arranged successively at a distance from each other which, when activated, are arranged to guide the people along one or more linear travel directions in the desired travel route leading to the specific point, wherein each of the first audio sources producing a directional audio signal which is communicated directly against each of the one or more the linear travel directions of the desired travel route, wherein the directional audio signals of two successive ones of the first audio sources, which are communicated directly against each of the one or more the linear travel directions of the desired travel route, are made to be distinguishable from each other by altering a frequency of at least one of the audio signals.

13. The guidance, control or warning system according to claim 12, wherein when the system is used at sites with several exits, the first audio sources are arranged successively in the desired travel routes to distribute the people at each of the sites dividedly to the several exits.

14. The system according to claim 12, further comprising:

a second audio source located adjacently to the first audio source located at each of the specific points on the desired travel route which requires a special action, the specific points of the route requiring the special action including an exit, a door, or a staircase, wherein a second sound signal produced by each of the second audio sources at the specific points requiring the special action is directed straight downwardly from above, thereby distinguishing the second sound signal, which is directed downwardly, from the directional audio signal of the adjacent first audio source, which is communicated directly against each of the one or more of the linear travel directions.

15. The system according to claim 12, wherein, an audio pattern of each of the first audio sources further behind in the desired travel direction of the route extends into an audio pattern of an immediately preceding first audio source.

16. The system according to claim 12, wherein each of the audio sources is a planar audio element producing the directional audio signal.

17. The system according to claim 12, wherein each of the first audio sources is controlled to produce a directional audio pattern which ranges at a distance of 5-40 meters, respectively.

18. The system according to claim 12, wherein successive first audio sources are arranged at a distance of 10-40 meters from each other.

19. The system according to claim 12, wherein the first audio sources are controlled to alter a directional audio pattern by changing a sound pressure.

20. The system according to claim 12, wherein, the system is fittable to hotels, public spaces, shopping centers, passenger terminals, service stations, office buildings, residential buildings, or to ships.

21. The system according to claim 12, wherein, the first audio sources are arranged to be utilized for communicating information.

* * * * *